US005392901A

United States Patent [19]

Kuray et al.

[11] Patent Number: 5,392,901

[45] Date of Patent: Feb. 28, 1995

[54] CONTAINER AND TRAY ASSEMBLY

[76] Inventors: Jeffrey W. Kuray, 1501 Monte Vista La.; Howard E. Craft, P.O. Box 21, 320 Clarkellen Rd., both of Gillette, Wyo. 82716

[21] Appl. No.: 151,124

[22] Filed: Nov. 12, 1993

[51] Int. Cl.[6] ..... F42B 39/00; B65D 85/00

[52] U.S. Cl. ..... 206/3; 206/372; 220/505; 220/528

[58] Field of Search ..... 206/372, 373, 3, 315.11, 206/514; 220/23.83, 23.86, 505, 528, 527, 523, 524

[56] References Cited

U.S. PATENT DOCUMENTS

| | | | |
|---|---|---|---|
| 4,091,953 | 5/1978 | Daenen | 220/23.86 |
| 5,001,034 | 4/1991 | Abel | 220/23.86 |
| 5,271,520 | 12/1993 | McAfee | 206/373 X |
| 5,337,892 | 8/1994 | Zaffina | 206/315.11 |

*Primary Examiner*—Paul T. Sewell
*Assistant Examiner*—Ted Kavanaugh

[57] ABSTRACT

A container for carrying loaded and fired shotgun shells and accessories, the container comprising, a cylindrical container with an internal diameter of between 12 inches and 16 inches. A circular lip positioned upon the internal surface of the container intermediate the opened top and the closed bottom of the container. A circular tray having a centrally positioned oblong handle portion and eight recesses formed within the upper portion of the tray adapted to receive boxes of standard shot gun loads. The bottom portion of the tray adapted to be received upon the circular lip. A hollow storage lid having an internal surface and an external surface, an opened upper portion and a closed lower portion. The closed lower portion adapted to engage the open top of the cylindrical container. A circular lip positioned upon the internal surface of the storage lid adjacent the open upper portion with a storage lid cover adapted to be positioned upon the circular lip of the storage lid. The lid cover serving to close the opened upper portion of the storage lid. A wire container handle having two ends, each end of the wire container handle adapted to be positioned within an aperture of a bracket positioned on opposed sides of the container.

3 Claims, 4 Drawing Sheets

CONTAINER AND TRAY ASSEMBLY

BACKGROUND OF THE INVENTION

1. Field of the Invention

The present invention relates to a container and tray assembly and more particularly pertains to a device for transporting loaded and fired shotgun shells and accessories.

2. Description of the Prior Art

The use of container and tray assemblies is known in the prior art. More specifically, a container with an internal and removable tray are known to consist basically of familiar, expected and obvious structural configurations, notwithstanding the myriad of designs encompassed by the crowded prior art which have been developed for the fulfillment of countless objectives and requirements.

Design U.S. Pat. No. 329,140 to Maride discloses an ornamental design for a carrying case for shotgun shells.

For example, U.S. Pat. No. 3,459,327 to Harris discloses a shell and accessory case for skeet and trapshooters.

U.S. Pat. No. 4,194,657 to Thor discloses a shotgun ammunition container. The container includes a self locking lid.

U.S. Pat. No. 3,616,976 to Geretschaeger discloses a box with individual components for transporting articles.

Furthermore, U.S. Pat. No. 4,757,894 Schreckenstein discloses a carrying case for shotgun shells. The case includes a plurality of individual cylindrical shell receiving pockets.

While these containers fulfill their respective, particular objectives and requirements, the aforementioned patents do not describe a cylindrical container with an internal circular tray for the transportation of loaded and unloaded shotgun shells. Furthermore, the aforementioned patents do not describe a cylindrical container with a hollow lid for the storage of shooting accessories.

In this respect, the container according to the present invention substantially departs from the conventional concepts and designs of the prior art, and in so doing provides a container specifically adapted to hold loaded and unloaded shotgun shells and other shooting accessories.

Therefore, it can be appreciated that there exists a continuing need for new and improved container and tray assembly which can be used for shooting accessories. In this regard, the present invention substantially fulfills this need.

SUMMARY OF THE INVENTION

In view of the foregoing disadvantages inherent in the known types of containers now present in the prior art, the present invention provides an improved container and tray assembly. As such, the general purpose of the present invention, which will be described subsequently in greater detail, is to provide a new and improved container and tray assembly apparatus and method which has all the advantages of the prior art xx and none of the disadvantages.

To attain this, the present invention essentially comprises a container for carrying loaded and fired shotgun shells and accessories, the container comprising, in combination, a cylindrical container having an internal surface and an external surface with an internal diameter of between 12 inches and 16 inches the container including an opened top and a closed bottom, three stiffening rings positioned about the periphery of the container adjacent the open top. Two diametrically opposed brackets are provided, each bracket perpendicular to and integral with one of the stiffening rings of the cylindrical container with an aperture formed within each of the brackets. A circular lip is positioned upon the internal surface of the container intermediate the opened top and the closed bottom of the container. A circular tray has an upper portion and a bottom portion, the tray having a centrally positioned oblong handle portion, the handle portion having a first end and a second end with a first set of apertures positioned at the first end and a second set of apertures positioned at the second end, the circular tray further including eight recesses formed within the upper portion of the tray, each of the recesses being adapted to receive boxes of standard shot gun loads, the bottom portion of the circular tray adapted to be received upon the circular lip. First and second tray handle elements are provided, each of the tray handle elements having a u-shaped body with a pair of side extension portions, each of the side extension portions being connected to one of the ends of the u-shaped body, the first tray handle element positioned through the first set of apertures of the handle portion, the second tray handle element positioned through the second set of apertures of the handle portion. Four clip elements are also provided, each of the clip elements adapted to connect one of the side extension portions of the tray handle element to the bottom surface of the circular tray; a cylindrical tray handle grip adapted to be connected to both of the tray handle elements. A hollow storage lid has an internal surface and an external surface, an opened upper portion and a closed lower portion, the closed lower portion adapted to engage the open top of the cylindrical container, a circular lip positioned upon the internal surface of the storage lid adjacent the open upper portion, a storage lid cover adapted to be positioned upon the circular lip of the storage lid, the lid cover serving to close the opened upper portion of the storage lid. A wire container handle has two ends and a straight intermediate portion, each end of the wire container handle adapted to be positioned within the apertures of the diametrically opposed brackets. Lastly, a cylindrical container handle grip is adapted to be positioned about the straight intermediate portion of the wire handle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container and tray assembly which has all the advantages of the prior art containers and none of the disadvantages.

It is another object of the present invention to provide a new and improved container and tray assembly which may be easily and efficiently manufactured and marketed.

It is a further object of the present invention to provide a new and improved container and tray assembly which is of a durable and reliable construction.

An even further object of the present invention is to provide a new and improved container and tray assembly which is susceptible of a low cost of manufacture with regard to both materials and labor, and which accordingly is then susceptible of low prices of sale to the consuming public, thereby making such container and tray assembly economically available to the buying public.

Still yet another object of the present invention is to provide a new and improved container and tray assembly which provides in the apparatuses and methods of the prior art some of the advantages thereof, while simultaneously overcoming some of the disadvantages normally associated therewith.

Still another object of the present invention is to transport loaded and fixed shotgun shells and accessories.

Yet another object of the present invention is to simply simplify the activities of sports persons.

Even still another object of the present invention is to provide a new and improved a container for carrying loaded and fired shotgun shells and accessories, the container comprising, a cylindrical container having an internal surface and an external surface with an internal diameter of between 12 inches and 16 inches the container including an opened top and a closed bottom, three stiffening rings positioned about the periphery of the container adjacent the open top; two diametrically opposed brackets, each bracket perpendicular to and integral with one of the stiffening rings of the cylindrical container with an aperture formed within each of the brackets; a circular lip positioned upon the internal surface of the container intermediate the opened top and the closed bottom of the container; a circular tray having an upper portion and a bottom portion, the tray having a centrally positioned oblong handle portion, the handle portion having a first end and a second end with a first set of apertures positioned at the first end and a second set of apertures positioned at the second end, the circular tray further including eight recesses formed within the upper portion of the tray, each of the recesses being adapted to receive boxes of standard shot gun loads, the bottom portion of the circular tray adapted to be received upon the circular lip; first and second tray handle elements, each of the tray handle elements having a u-shaped body with a pair of side extension portions, each of the side extension portions being connected to one of the ends of the u-shaped body, the first tray handle element positioned through the first set of apertures of the handle portion, the second tray handle element positioned through the second set of apertures of the handle portion; a hollow storage lid having an internal surface and an external surface, an opened upper portion and a closed lower portion, the closed lower portion adapted to engage the open top of the cylindrical container, a circular lip positioned upon the internal surface of the storage lid adjacent the open upper portion with a storage lid cover adapted to be positioned upon the circular lip of the storage lid, the lid cover serving to close the opened upper portion of the storage lid; and a wire container handle having two ends and a straight intermediate portion, each end of the wire container handle adapted to be positioned within the apertures of the diametrically opposed bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
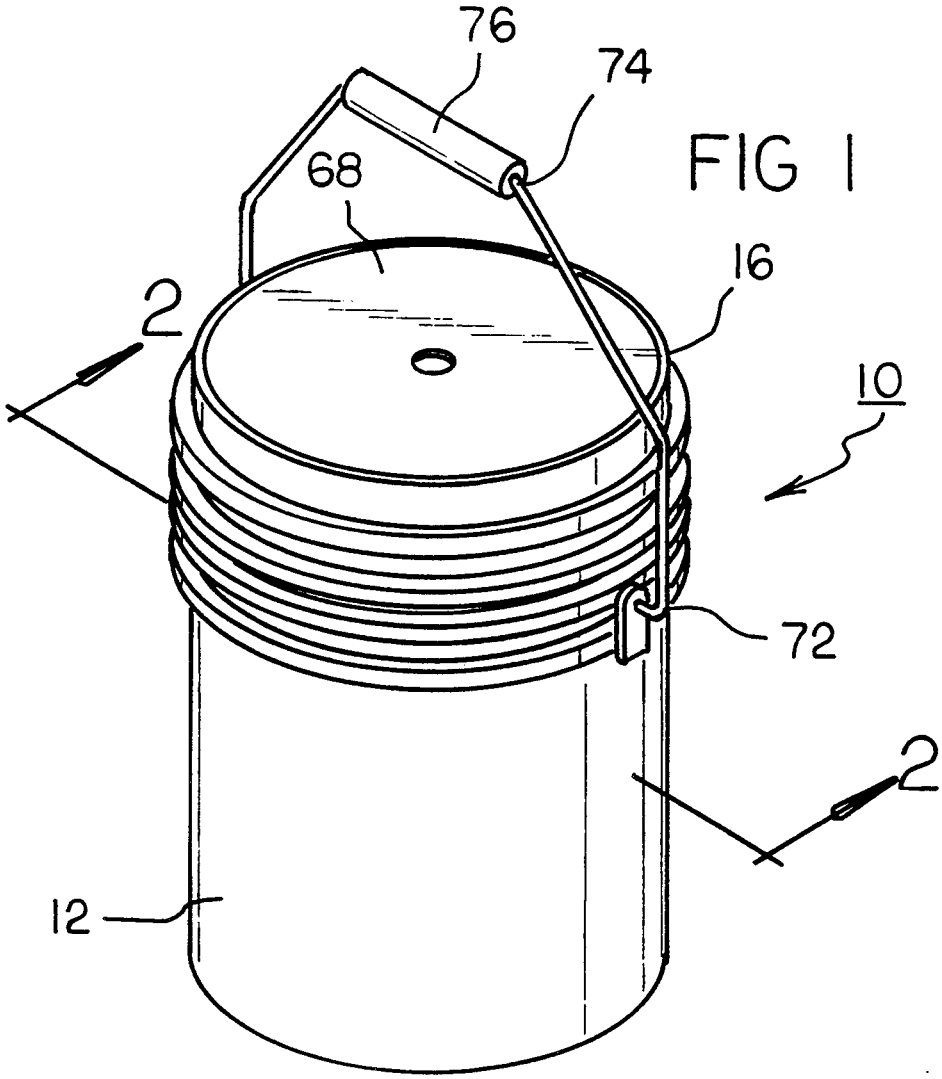
FIG. 1 is a perspective view of a container and tray assembly constructed in accordance with the principles of the present invention.
Figure 2:
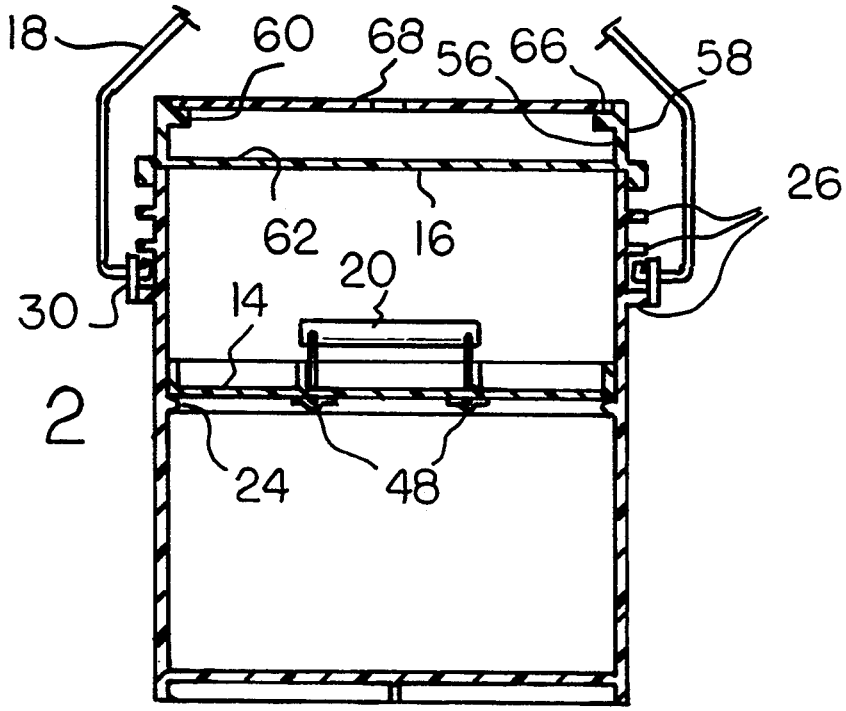
FIG. 2 is a sectional view taken along line 2—2 of FIG. 1.
Figure 3:
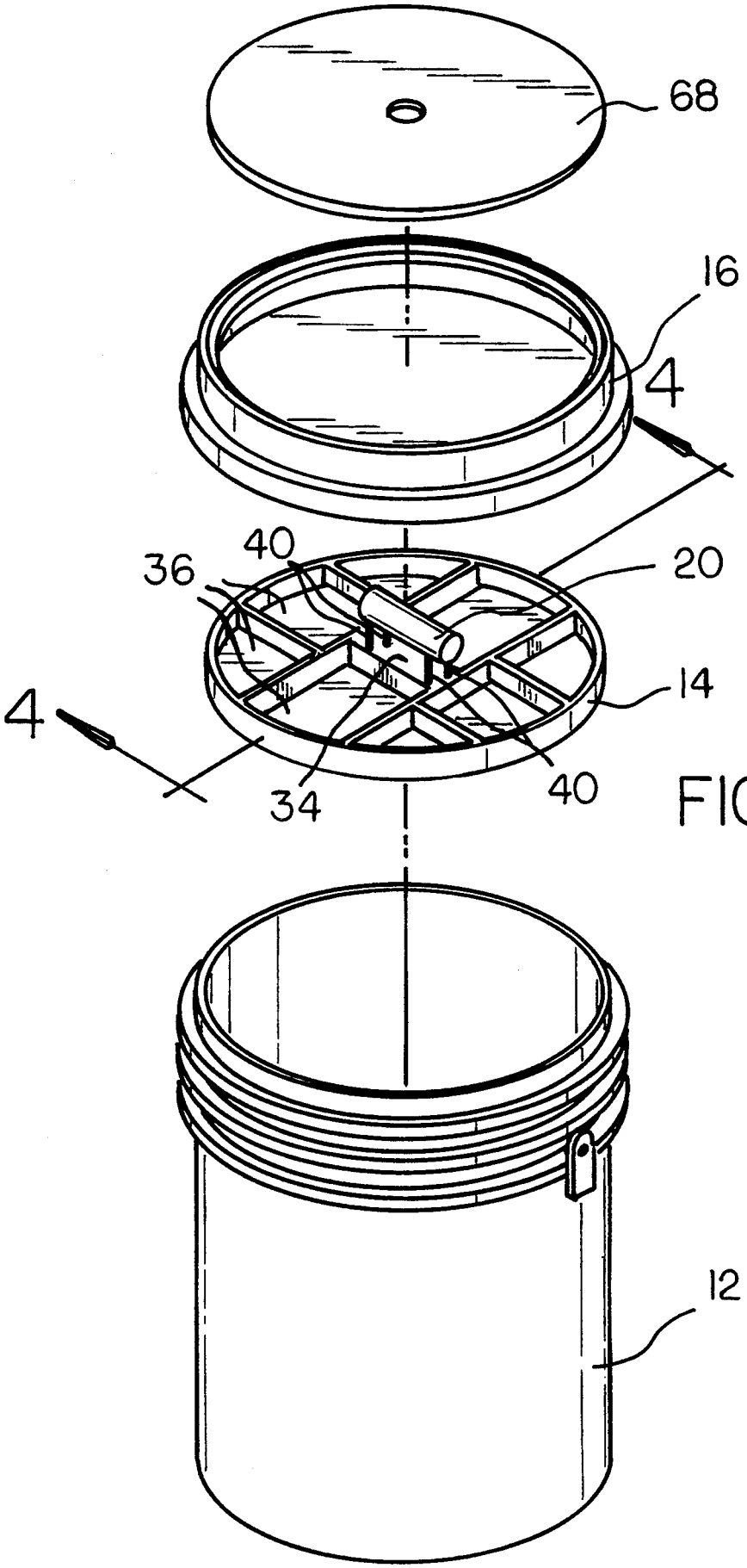
FIG. 3 is an exploded perspective view of the apparatus of the prior figures.
Figure 4:
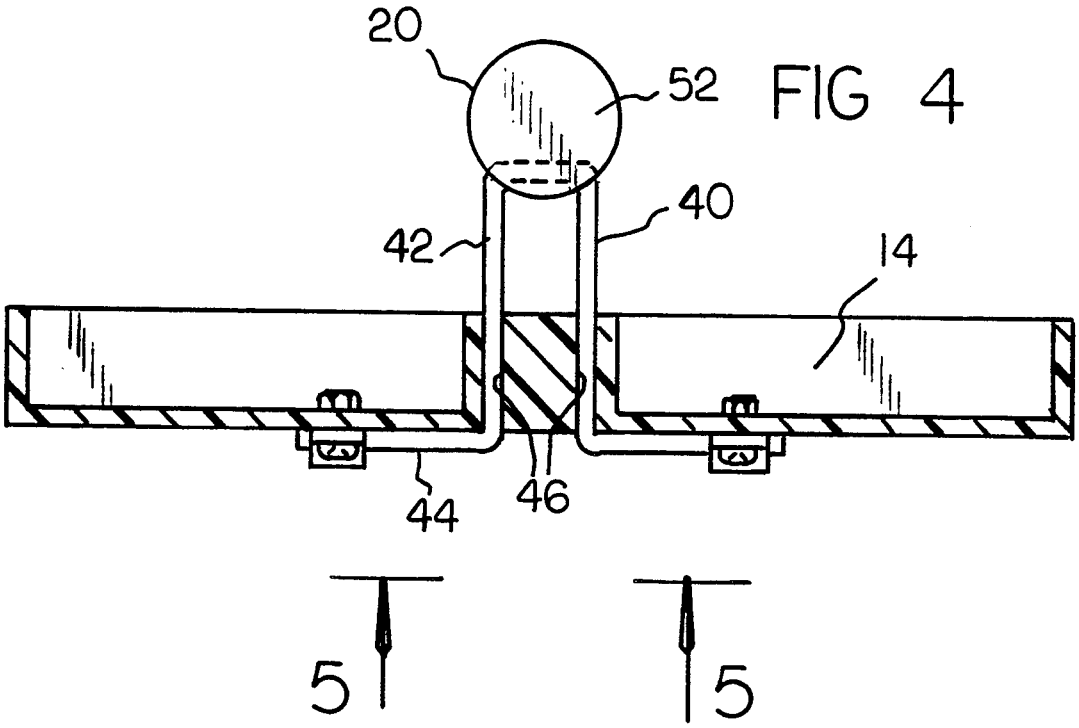
FIG. 4 is a sectional view taken along line 4—4 of FIG. 3.
Figure 5:
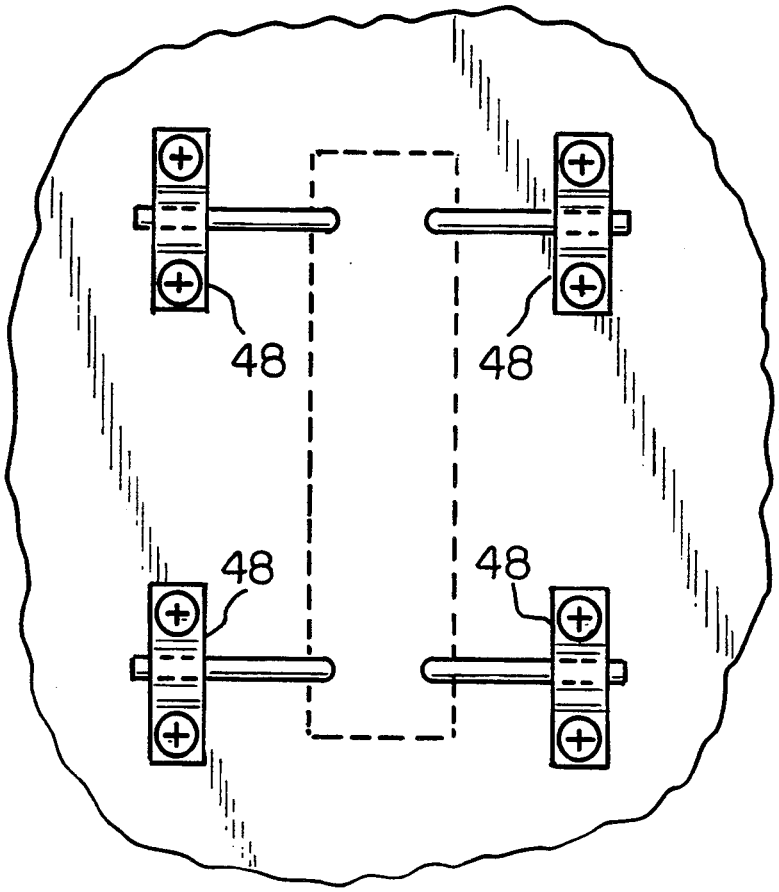
FIG. 5 is a sectional view taken along line 5—5 of FIG. 4.

With reference now to the drawings, and in particular to FIG. 1 thereof, a new and improved container and tray assembly embodying the principles and concepts of the present invention and generally designated by the reference numeral 10 will be described.

More specifically, it will be noted that the present invention relates to a container assembly 10 for carrying loaded and fired shotgun shells and accessories. Broadly, the present invention includes a container 12, an interior tray 14, a hollow storage lid 16 which serves a cover for the container, a container handle 18 and a tray handle 20. The tray 14 is adapted for carrying boxes of standard 2¾ inch trap or target shot gun loads. The interior of the container is adapted to carry fired shotgun shell hulls. Furthermore, the storage lid 16 is adapted to carry shooting accessories such as ear protectors, glasses, and gloves. Thus, the container assembly 10 of the present invention allows for the comfortable transportation of shotgun shells, hulls and related accessories around a sporting clay course, trap or skeet range.

The cylindrical container 12 is defined by an internal surface and an external surface with an internal diameter of between 12" and 16". The container includes an opened top and a closed bottom. A circular lip 24 is positioned upon the internal surface of the container intermediate the opened top and the closed bottom. Furthermore, three stiffening rings 26 are positioned about the periphery of the container adjacent the open top in order to provide rigidity to the container. The container as described, as with most of the container assembly of the present invention, is constructed from a high impact plastic. Two brackets 30 are included about the periphery of the container upon its external surface. The two diametrically opposed brackets are each integral with and perpendicular to one of the stiffening rings of the container. Each of the brackets includes a centrally formed aperture.

The interior tray 14 of the present invention is circular in shape and includes an upper portion and a bottom portion. The tray is formed with a centrally positioned oblong handle portion 34 having a first end and a second end. A first set of apertures are positioned at the first end, and a second set of apertures are positioned at the second end. The circular tray further includes at eight recesses 36 formed within the upper portion of the tray. Although eight recess is specified in the preferred embodiment, it is within the scope of the present invention to increase the number of recesses. Each of the recesses is specifically adapted to receive boxes of standard shot gun loads. These may be boxes of standard 2¾ inch trap or target shot gun shells. The bottom portion of the circular tray adapted to be received upon the circular lip. Thus, the entire tray is adapted to rest within the container.

The tray handle 20 includes first and second tray handle elements 40. Each of the tray handle elements includes a u-shaped body 42 with a pair of side extension portions 44. Each of the side extension portions is connected to one of the ends of the u-shaped body. The first tray handle element is positioned through the first set of apertures 46 of the handle portion, and the second tray handle element is positioned through the second set of apertures of the handle portion. Four clip elements 48 are employed to secure the tray handle elements to the tray. Each clip element is adapted to connect one of the side extension portions 44 to the bottom surface of the circular tray. A cylindrical tray handle grip 52 is adapted to be connected to both of the tray handle elements.

The hollow storage lid 16 of the present invention has an internal surface 56 an external surface 58 an opened upper portion 60 and a closed lower portion 62. The closed lower portion is adapted to engage the open top of the cylindrical container. The lid further includes a circular lip 66 positioned upon its internal surface adjacent the open upper portion. A storage lid 68 cover is adapted to be positioned upon the circular lip of the storage lid. The lid cover serving to close the opened upper portion of the storage lid. Thus, the hollow storage lid serves as a cover for the entire container assembly. Furthermore, shooting accessories can be stored within the interior of the storage lid.

A wire container handle 18 which has two ends 72 and a straight intermediate portion 74 is employed in carrying the entire container assembly. Each end of the wire container handle is adapted to be positioned within one of the apertures of the diametrically opposed brackets 30. Furthermore, to aid in carrying the container assembly a cylindrical container handle grip 76 is adapted to be positioned about the straight intermediate portion of the wire handle.

Figure 6:
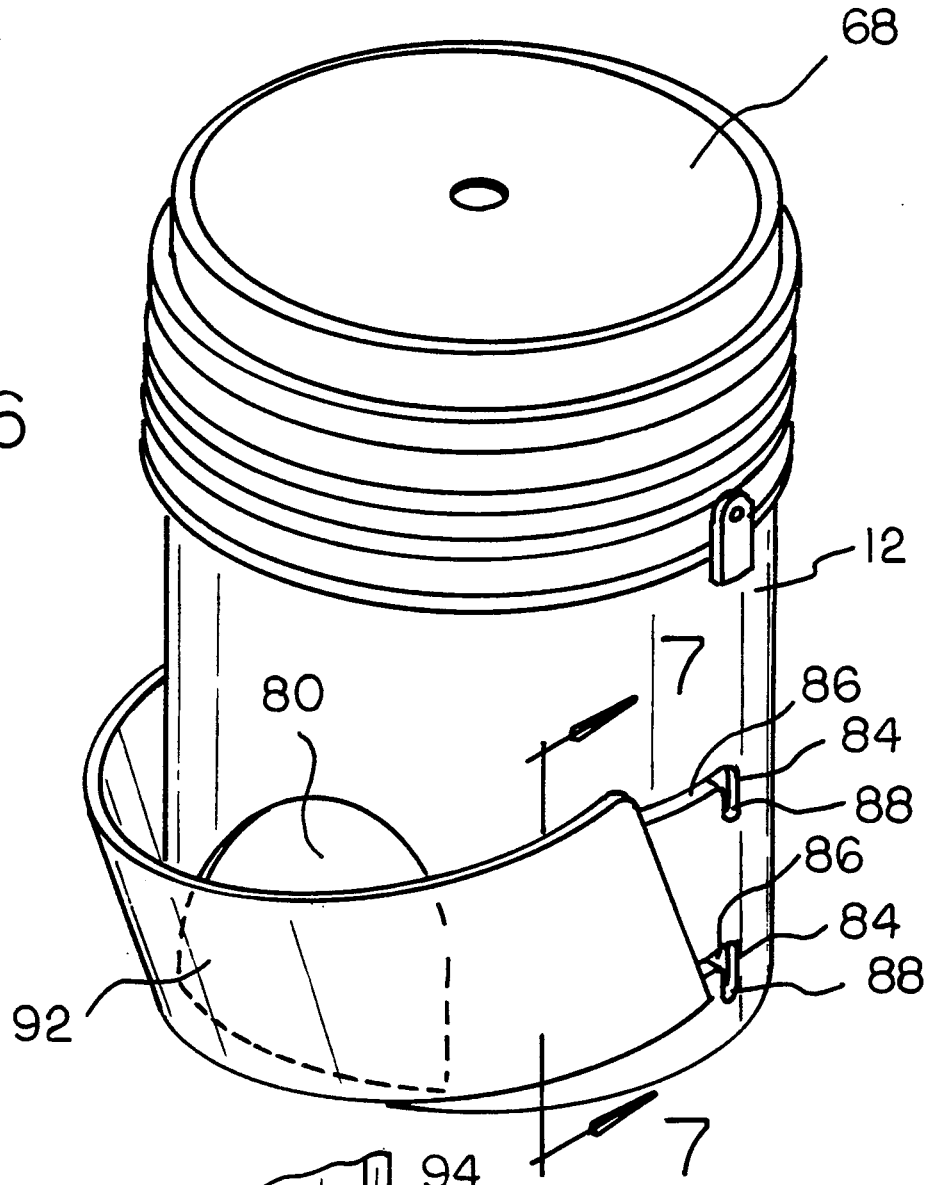
FIG. 6 is a perspective view of a container and tray assembly constructed in accordance with an alternate embodiment of the invention.
Figure 7:
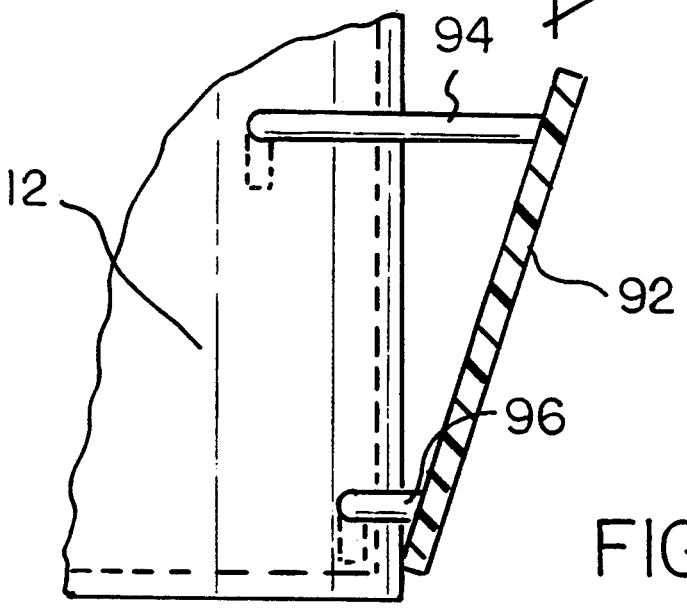
FIG. 7 is a sectional view taken along line 7—7 of FIG. 6.

The container assembly of the second embodiment of the present invention, as shown in FIGS. 6 and 7, is substantially the same as that of the first embodiment. However, an aperture 80 is formed within the container adjacent its bottom. Additionally, a first and second set of slots 84 are formed within the container. Each of the slots includes a horizontal portion 86 and a vertical portion 88. The first set includes an upper slot and a lower slot, with the lower slot having a shorter horizontal portion. The second set includes an upper slot and a lower slot, with the lower slot having a shorter horizontal portion. The sets of slots are positioned such that the first set of slots is diametrically opposed from the second set of slots.

A container shield 92 is included in the second embodiment to selectively close or open the aperture of the container. The container shield has a curvature matching the curvature of the container. Furthermore, the container shield includes two sets of rods 94 and 96. With each of the sets adapted to ride within one of the sets of slots formed within the container. Thus, the container is adapted to cover the aperture of the container, with each of the rods positioned within the vertical portion of the slots, or to act as a funnel to the aperture of the container, with the rods within the horizontal portion of the slots.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container for carrying loaded and fired shotgun shells and accessories, the container comprising, in combination:

a cylindrical container having an internal surface and an external surface with an internal diameter of between 12 inches and 16 inches the container including an opened top and a closed bottom, three stiffening rings positioned about the periphery of the container adjacent the open top;

two diametrically opposed brackets, each bracket perpendicular to and integral with one of the stiffening rings of the cylindrical container with an aperture formed within each of the brackets;

a circular lip positioned upon the internal surface of the container intermediate the opened top and the closed bottom of the container;

a circular tray having an upper portion and a bottom portion, the tray having a centrally positioned oblong handle portion, the handle portion having a first end and a second end with a first set of apertures positioned at the first end and a second set of apertures positioned at the second end, the circular tray further including eight recesses formed within the upper portion of the tray, each of the recesses being adapted to receive boxes of standard shot gun loads, the bottom portion of the circular tray adapted to be received upon the circular lip;

first and second tray handle elements, each of the tray handle elements having a u-shaped body with a pair of side extension portions, each of the side extension portions being connected to one of the ends of the u-shaped body, the first tray handle element positioned through the first set of apertures of the handle portion, the second tray handle element positioned through the second set of apertures of the handle portion;

four clip elements, each of the clip elements adapted to connect one of the side extension portions of the tray handle element to the bottom surface of the circular tray;

a cylindrical tray handle grip adapted to be connected to both of the tray handle elements;

a hollow storage lid having an internal surface and an external surface, an opened upper portion and a closed lower portion, the closed lower portion adapted to engage the open top of the cylindrical container, a circular lip positioned upon the internal surface of the storage lid adjacent the open upper portion, a storage lid cover adapted to be positioned upon the circular lip of the storage lid, the lid cover serving to close the opened upper portion of the storage lid;

a wire container handle having two ends and a straight intermediate portion, each end of the wire container handle adapted to be positioned within the apertures of the diametrically opposed brackets; and a cylindrical container handle grip adapted to be positioned about the straight intermediate portion of the wire handle.

2. A container for carrying loaded and fired shotgun shells and accessories, the container comprising:

a cylindrical container having an internal surface and an external surface with an internal diameter of between 12 inches and 16 inches the container including an opened top and a closed bottom, three stiffening rings positioned about the periphery of the container adjacent the open top;

two diametrically opposed brackets, each bracket perpendicular to and integral with one of the stiffening rings of the cylindrical container with an aperture formed within each of the brackets;

a circular lip positioned upon the internal surface of the container intermediate the opened top and the closed bottom of the container;

a circular tray having an upper portion and a bottom portion, the tray having a centrally positioned oblong handle portion, the handle portion having a first end and a second end with a first set of apertures positioned at the first end and a second set of apertures positioned at the second end, the circular tray further including eight recesses formed within the upper portion of the tray, each of the recesses being adapted to receive boxes of standard shot gun loads, the bottom portion of the circular tray adapted to be received upon the circular lip;

first and second tray handle elements, each of the tray handle elements having a u-shaped body with a pair of side extension portions, each of the side extension portions being connected to one of the ends of the u-shaped body, the first tray handle element positioned through the first set of apertures of the handle portion, the second tray handle element positioned through the second set of apertures of the handle portion;

a hollow storage lid having an internal surface and an external surface, an opened upper portion and a closed lower portion, the closed lower portion adapted to engage the open top of the cylindrical container, a circular lip positioned upon the internal surface of the storage lid adjacent the open upper portion with a storage lid cover adapted to be positioned upon the circular lip of the storage lid, the lid cover serving to close the opened upper portion of the storage lid; and a wire container handle having two ends and a straight intermediate portion, each end of the wire container handle adapted to be positioned within the apertures of the diametrically opposed bracket.

3. The container as described in claim 2 further comprising:

an aperture formed within the container;

a first and second set of slots formed within the container, each of the slots including a horizontal portion and a vertical portion, the first set including an upper slot and a lower slot with the lower slot having a shorter horizontal portion, the second set including an upper slot and a lower slot with the lower slot having a shorter horizontal portion, the first set of slots being diametrically opposed from the second set of slots; and a container shield having a curvature matching the curvature of the container, the container shield having two sets of rods, each of the sets adapted to ride within one of the sets of slots formed within the container, the container thus adapted to cover the aperture of the container with each of the rods positioned within the vertical portion of the slots, the container shield also adapted to act as a funnel to the aperture of the container with the rods within the horizontal portion of the slots.

* * * * *